United States Patent [19]

Usagawa et al.

[11] 4,362,810

[45] * Dec. 7, 1982

[54] METHOD FOR FORMING A CYAN DYE IMAGE

[75] Inventors: Yasushi Usagawa, Hino; Wataru Fujimatsu, Hachioji; Osamu Sasaki, Hino; Katsumi Matsuura, Hachiaji, all of Japan

[73] Assignee: Konishiroku Photo Industry Co., Ltd., Japan

[ * ] Notice: The portion of the term of this patent subsequent to Nov. 10, 1998, has been disclaimed.

[21] Appl. No.: 223,696

[22] Filed: Jan. 9, 1981

[30] Foreign Application Priority Data

Jan. 11, 1980 [JP] Japan ..... 55-2305

[51] Int. Cl.[3] ..... G03C 7/00

[52] U.S. Cl. ..... 430/384; 430/385; 430/552; 430/553

[58] Field of Search ..... 430/384, 385, 472, 473, 430/552, 553

[56] References Cited

U.S. PATENT DOCUMENTS

| | | | |
|---|---|---|---|
| 2,801,171 | 7/1957 | Fierke et al. | 430/546 |
| 3,839,044 | 10/1974 | Salminen et al. | 430/553 |
| 4,124,396 | 11/1978 | Osborn | 430/553 |
| 4,299,914 | 11/1981 | Fujimatsu et al. | 430/553 |

*Primary Examiner*—J. Travis Brown

*Attorney, Agent, or Firm*—Finnegan, Henderson, Farabow, Garrett & Dunner

[57] ABSTRACT

A method of forming a cyan dye image by development of an exposed silver halide photographic material with a developer containing a 2,5-diacylaminophenol cyan coupler containing a substituted alkylsulfonylamino terminal moiety or a substituted alkylaminosulfonyl terminal moiety in the 2- or 5- position.

6 Claims, No Drawings

METHOD FOR FORMING A CYAN DYE IMAGE

The present invention relates to a method to form a cyan dye image, particularly to a method form a cyan dye image by color developing a silver halide photosensitive material for color photographic use in the presence of 2,5-diacylamino type cyan coupler. Further, the invention relates to a method to form a cyan dye image in the presence of a cyan coupler, which is better in solubility, despersion stability and spectral absorption characteristics, and has both higher speed of dye forming and greater color density especially when developed in color developing solution having excluded benzyl alcohol, and has, in addition, superior image preserving properties.

As is generally known, aromatic primary amine color developing agent reduces am exposed silver halide grains whereby oxidized product couple with a coupler. As for cyan couplers to form cyan dyes, the compounds having phenol and naphthol hydroxyl group are used.

As for the fundamental properties to be required for couplers, it is desired to have various characteristics not only that a dye can be simply formed, but also that the solubility to an organic solvent having a high boiling point or to alkali, etc. is greater; that the dispersibility and stability to silver halide photographic emulsions are better and the dyes formed thereby have registance against light, heat, humidity, etc.; that the spectral absorption characteristics are superior; that the transparency is better; that color density is greater; and further that the image obtained is sharper; especially in cyan couplers, it is required to improve the image preserving properties such as heat registance, humidity registance and light registance.

Further, in view of the anti-pollution measure nowadays, it is becoming at a great issue to eliminate benzyl alcohol which is added into color developer. However, it is the status quo in general that the color developability, viz, the dye forming speed and the maximum color density, of coupler added in silver halide photographic emulsion is lowered when used the color developer without adding any benzyl alcohol. And, such tendency will be shown remarkably in case of cyan coupler. Therefore, it is aspired in such cyan coupler that the color developability will not depend on benzyl alcohol, and the studies for the improvement are being pursued as well as the improvements of said image preserving properties.

There are so far known the following cyan couplers. For instance, the U.S. Pat. No. 2,801,171 discloses 6-[α-(2,4-di-tert-amylphenoxy)butaneamido]-2,4-di-chloro-3-methyl phenol, which has been used commercially in photographic materials extensively and has a excellent characteristics such as light registance, but has a fault in heat registance to which, in addition, dependence on benzyl alcohol in color developability is great, and the maximum color density is not sufficient when developed in color developer eliminated benzyl alcohol therefrom.

And, the coupler described in the U.S. Pat. No. 4,124,396, is the one in which dicarbonylamino group is substituted in place of 2 and 5-positions of phenol, and the publication describes that the dispersion stability at the time of coating or the finish of coating is improved by inducing p-alkylsulfonylaminophenoxy group or p-alkylaminosufonylphenoxy group into the terminal of the substituent at 5th position, however as is obvious from the examples to be given hereafter, there is a great dependence upon benzyl alcohol in color developability, therefore some more improvements have to be required at the above problem.

Upon the above, it is an object of the invention to provide a cyan coupler having such desirable characteristics as required for cyan coupler mentioned above.

It is another object of the invention to provide a cyan coupler having superiorities of solubility into alkali or organic solvent with its high boiling point, and dispersibility and stability in silver halide emulsion for color photographic use.

It is further object of the invention to provide a method to form a cyan dye image having a superior image preservabilities, viz, superior registances against heat, light and humidity, and, further having a high speed of dye forming as well as giving a cyan dye image having a great color density when developed in a color developer eliminated benzyl alcohol therefrom.

Cyan coupler in the present invention in a 2,5-diacylaminophenol cyan coupler containing a substituted alkylsulfonylamino terminal moiety or a substituted alkylaminosulfonyl terminal moiety in the 2- or 5-position substituent of the molecule.

Our cyan coupler is concretely represented by the following formula [I] or [II]:

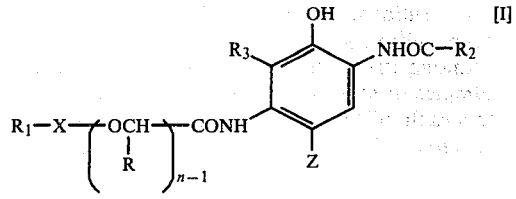

[I]

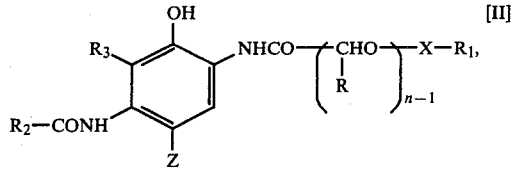

[II]

Wherein, R represents hydrogen atom, or alkyl group having 1 to 20 numbers of carbon; $R_1$ represents substituted alkylsulfonylamino group or substituted alkylaminosulfonyl group; $R_2$ represents alkyl group, aryl group, or hetrocyclic group; $R_3$ represents hydrogen atom or halogen atom; X represents phenylene group, naphthylene group or alkylene group; Z represents conpling-off group; and n has an integral value of 1 or 2.

R is concretely represented by $Y—R_4—SO_2NH—$ or $Y—R_4—NHSO_2—$, wherein $R_4$ is branched or normal chain alkylene of 1 to 20 carbon atoms and Y is selected from a group consisting of R'O—, R'COO—, R'OCO—; R'S—, $R'SO_2$—, R'CO—,

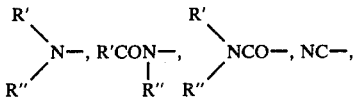

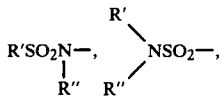

R'OSO—, $O_2N$— and halogen wherein each of R' and R'' is hydrogen, alkyl, phenyl, or 4 to 6 membered haterrocycle containing oxygen, nitrogen or sulfur.

In the preferable emfodiment of the present invention, Y mentioned above is R'O—, R'COO—, R'O-CO—, R'S—, $R'SO_2$—, R'CO—,

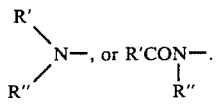

And, bis type 2,5-diacyl aminophenol cyan coupler, which is coupled through $R_1$, is also suitable for the objects of the present invention.

With respect to more concrete examples of $R_2$; they are given as to alkyl groups, methyl, ethyl, isopropyl, butyl, ter-butyl, dodecyl, pentadecyl, and cyclohexyl group, etc.; as for aryl groups, phenyl, naphthalene, etc.; and as for heterocyclic groups, 4-6 membered and containing a nitrogen, oxygen or suefur atom such as furan group. Further, as for the substituents to be substituted for the above groups for $R_2$, they are given as halogen atom (i, e chlorine, bromine, fluorine, etc.), alkyl group, nitro group, hydroxy group, carboxy group, amino group, sulfo group, cyano group, alkoxy group, aryloxy group, arylthio group, acylamino group, carbamoyl group, ester group, acyl group, acyloxy group, sulfonamide group, sulfamoyl group, sulfonyl group, sulfoxy group, oxysulfonyl group, etc.

Among the aforementioned X groups, the concrete examples of alkylene group are given as that X represents each of the groups of methylene, ethylene, butylene, etc., and, the following substituents may be substituted for alkylene group and/or said phenylene group and naphthylene group.

For example, they are given as alkyl group (e.g., methyl group, ethyl group, isobutyl group, dodecyl group, ter-acyl group, cyclohexyl group, pentadecyl group, etc.), alkenyl group (e.g., aryl group, etc.), aryl group, heterocyclic group, halogen atom (e.g., chlorine, bromine, fluorine atoms, etc.), nitro group, hydroxy group, carboxy group, amino group, sulfo group, alkoxy group, aryloxy group, arylthio group, acylamino group, ester group, acyl group, acyloxy group, sulfonamido group, sulfamoyl group, sulfonyl group, molpholino group, etc.

And R represents hydrogen atom or alkyl group having 1 to 20 carbon number, and the concrete examples of said alkyl groups are given as each of methyl group, ethyl group, butyl group, dodecyl group, etc.

Z is a coupling-off group, which is well known to the skilled in the art, and the examples are hydrogen, or split-off group when coupled halogen, aryloxy group carbamoyloxy group, carbamoylmethoxy group, acyloxy group, alkyloxy group, sulfonamido group, succinimide group; with each of which oxygen atom or nitrogen atom is coupled directly at the 4th position of phenol ring, further concrete examples, which are useful, are given as the described in the U.S. Pat. No. 3,471,563, the Japanese Pat. O.P.I. Publication No. 37425/1972, the Japanese Patent Publication No. 36894/1973, the Japanese Patent O.P.I. Publication Nox. 10135/1975, 117422/1975, 130441/1975, 108841/1976, 120334/1975, 18315/1977, 52423/1978, 105226/1978, etc.

Next, the following are given as the typical concrete examples of the couplers of the invention.

[I]

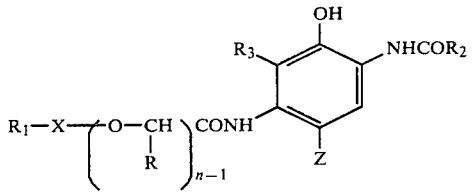

| Coupler No. | $R_1$ | X | $R_2$ | $R_3$ | R | n | Z |
|---|---|---|---|---|---|---|---|
| 1 | $C_2H_5OCH_2CH_2SO_2NH$— | 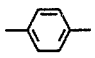 | 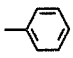 | H | $-C_{12}H_{25}$ | 2 | Cl |
| 2 | $C_9H_{19}$— 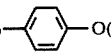 —$O(CH_2)_3SO_2NH$— | 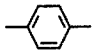 | 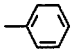 | H | $-C_2H_5$ | 2 | H |
| 3 | $CH_3COOCH_2CH_2SO_2NH$— | 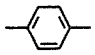 | $-C(CH_3)_3$ | H | $-C_{14}H_{29}$ | 2 | $-OCH_2COOCH_3$ |
| 4 | $C_4H_9NH(CH_2)_3SO_2NH$— | 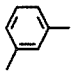 | 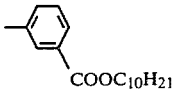 $COOC_{10}H_{21}$ | H | H | 2 | —O— 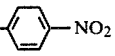 —$NO_2$ |
| 5 | $C_{12}H_{25}O(CH_2)_3SO_2NH$— | 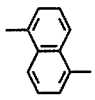 | $-C_3F_7$ | H | $-C_2H_5$ | 2 | $-OCOOC_2H_5$ |

-continued
[I]
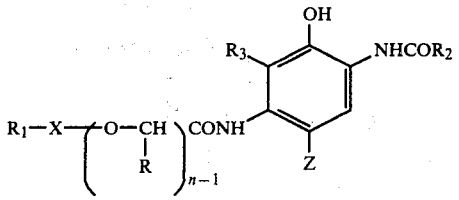
| Coupler No. | $R_1$ | X | $R_2$ | $R_3$ | R | n | Z |
|---|---|---|---|---|---|---|---|
| 6 | $Cl(CH_2)_3SO_2NH-$ | 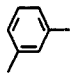 | 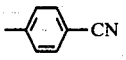 | H | $-C_{14}H_{29}$ | 2 | 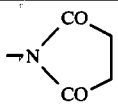 |
| 7 | $CH_3SO_2CH_2CH_2SO_2NH-$ | 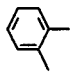 | 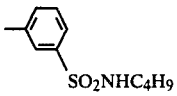 | H | $-C_{12}H_{25}$ | 2 | 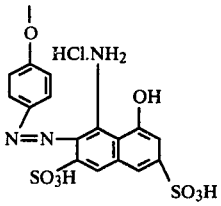 |
| 8 | $CH_3SCH_2CH_2SO_2NH-$ | 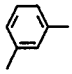 | 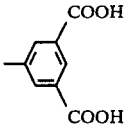 | H | H | 2 | H |
| 9 | 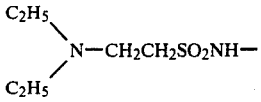 | 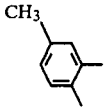 | 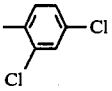 | H | H | 2 | 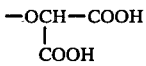 |
| 10 | 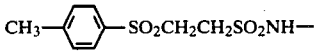 | 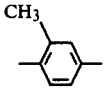 | 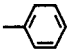 | H | $-C_{12}H_{25}$ | 2 | Cl |
| 11 | 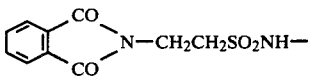 | 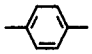 | 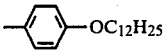 | H | $-C_2H_5$ | 2 | H |
| 12 | 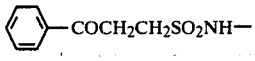 | 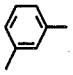 | $-C(CH_3)_3$ | H | $-C_{14}H_{29}$ | 2 | Cl |
| 13 | $NO_2CH_2CH_2SO_2NH-$ | 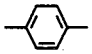 | 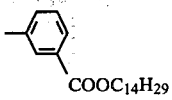 | H | H | 2 | Cl |
| 14 | $CF_3CH_2SO_2NH-$ | 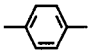 | 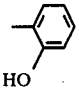 | H | $-C_{12}H_{25}$ | 2 | Cl |
| 15 | 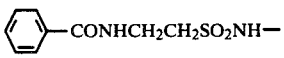 | 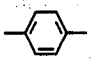 | 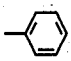 | Br | $-C_{12}H_{25}$ | 2 | Br |
| 16 | 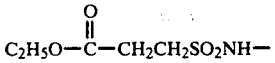 | $-(CH_2)_3-$ | 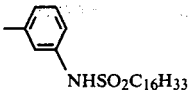 | H | — | 1 | H |

-continued
[I]
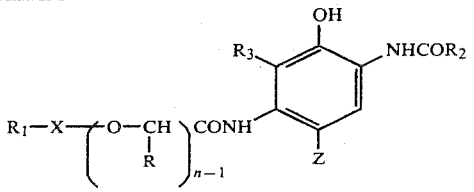
| Coupler No. | $R_1$ | X | $R_2$ | $R_3$ | R | n | Z |
|---|---|---|---|---|---|---|---|
| 17 | $HO(CH_2)_3SO_2NH-$ | 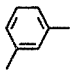 | 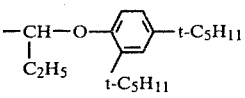 | H | — | 1 | 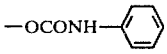 |
| 18 | 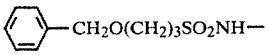 | 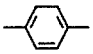 | $-C_{13}H_{27}$ | H | H | 2 | H |
| 19 | $HOOC(CH_2)_2NHSO_2-$ | 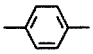 | $-C_2F_4H$ | H | $-C_{12}H_{25}$ | 2 | 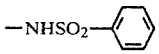 |
| 20 | 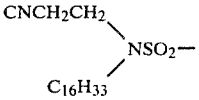 | 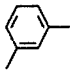 | 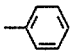 | H | $-C_2H_5$ | 2 | Cl |
| 21 | $C_8H_17O(CH_2)_3NHSO_2-$ | 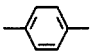 | 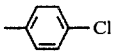 | H | $-C_2H_5$ | 2 | 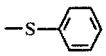 |
| 22 | 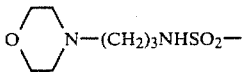 | 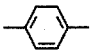 | 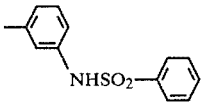 | H | $-C_{10}H_{21}$ | 2 | H |
| 23 | $C_{14}H_{29}CONH(CH_2)_3NHSO_2-$ | 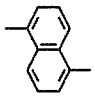 | $-C_3H_7$ | H | $-C_2H_5$ | 2 | Cl |
| 24 | $CH_3OCH_2CH_2NHSO_2-$ | 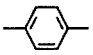 | 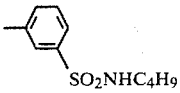 | H | $-C_{12}H_{25}$ | 2 | H |
[II]
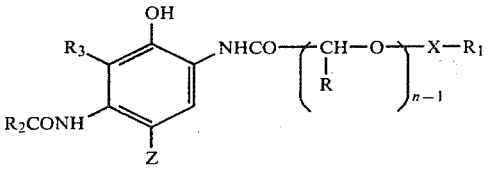
| Coupler No. | $R_1$ | X | $R_2$ | $R_3$ | R | n | Z |
|---|---|---|---|---|---|---|---|
| 25 | 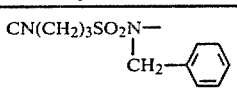 | 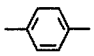 | 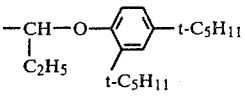 | H | $-C_2H_5$ | 2 | H |
| 26 | $CH_3OCH_2CH_2OCH_2SO_2NH-$ | 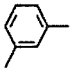 | $-C(CH_3)_3$ | H | $-C_{12}H_{25}$ | 2 | Cl |

-continued

[II]

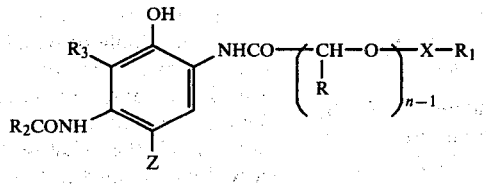

| Coupler No. | $R_1$ | X | $R_2$ | $R_3$ | R | n | Z |
|---|---|---|---|---|---|---|---|
| 27 | $C_{12}H_{25}OC(=O)CH_2OC(=O)(CH_2)_2NHSO_2-$ | 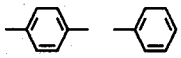 | | H | H | 2 | H |
| 28 | 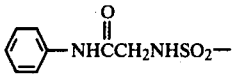 | 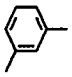 | 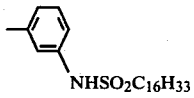 | Cl | — | 1 | Cl |
| 29 | $C_2H_5OCH_2CH_2SO_2NH-$ | 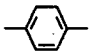 | 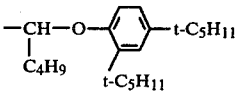 | H | — | 1 | Cl |
| 30 | $H_2NCH_2CH_2SO_2NH-$ | 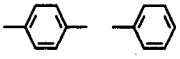 | | H | $-C_{12}H_{25}$ | 2 | H |
| 31 | 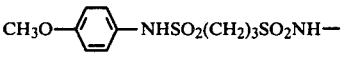 | 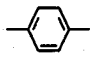 | $-C_{13}H_{27}$ | H | H | 2 | H |
| 32 | 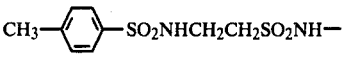 | 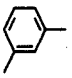 | 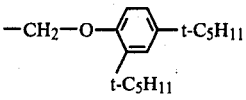 | H | $-C_2H_5$ | 2 | H |
| 33 | 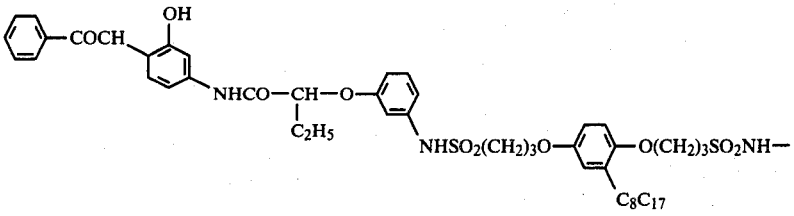 | | | | | | |
| | 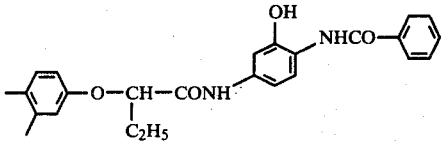 | | | | | | |
| 34 | 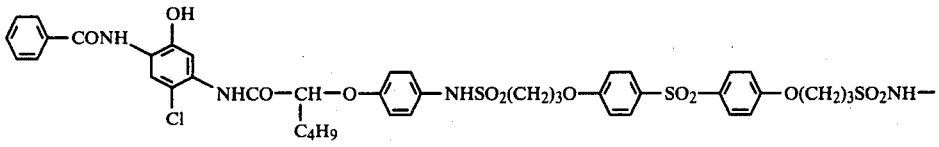 | | | | | | |
| | 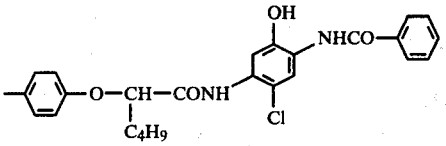 | | | | | | |

The conplers according to the present invention can be synthesized in a same way as well known method, one of the example of which is described in U.S. Pat. No. 4,124,396.

The following examples are given as the typical synthesis method of the couplers of the invention:

Synthesis example (Sample coupler No. 1)

(a) Synthesis of ethylα-(p-ethoxyethylsulfonylaminophenoxy) tetradecanoate (intermediate A)

Ethyl-α-(p-aminophenoxy)tetradecanoate of 7.3 g which had been synthesized by making use of the method described in the U.S. Pat. No. 4,124,396 and 1.9 g of pyridine were dissolved in 60 ml of tetrahydrofuran and they were stirred together at the room temperature, and then 20 ml of tetrahydrofuran solution of 3.6 g of ethoxyethylsulfonyl chloride were dropped therein. After dropped in and stirred to make reflux for three hours, the resulted mixture was poured in the solution of 200 ml of ice water and 12 ml of conc hydrochloride. Ethyl acetate was added to extract an object. The extract was concentrated after washing and drying, and the residual was processed by means of column, and 5.4 g (54%) of brown colored oil have been obtained. The constitution thereof has been confirmed by means of MMR.

(b) Synthesis of α-(p-ethoxyethyl sulfonyl amino phenoxy) tetradecanoic acid (intermediate B)

5.2 g of intermediate A obtained by the example (a) was dissolved in 25 ml of ethanol and then 20 ml of ethanol solution of 2.1 g of potassiumhydroxide was added. After making reactions for three hours, the resulted mixture was poured in ice water containing 40 ml of 1 N-HCl, and after extraction was made with ethylacetate and washing and drying were made, and then 5.0 g (100%) of brown colored oil have been obtained.

(c) Synthesis of α-(p-ethoxyethylsulfonylaminopehnoxy) tetradecanoyl chloride (intermediate C)

4.5 g of intermediate B obtained by the example (b) was dissolved in 50 ml of benzene and stirred at the room temperature, and 7 ml of thionylchloride was then added therein. After stirred to make reflus for three hours, concentration was made, and 4.7 g (100%) of brown oil have been obtained.

(d) Synthesis of 2-benzoylamino-5-[α-(p-ethoxy ethyl sulfonyl amino phenoxy)-α-(dodecyl)acetylamino]phenol (intermediate D)

2-benzoylamino-5-aminophenol of 2.2 g was dissolved in 30 ml of ethyl acetate and stirred to make reflux, and then ethylacetate solution of 4.7 g of the intermediate C was dropped therein. After stirred to make reflux for two hours, the mixture reacted was poured in water and organic layer was separated therefrom. After washed and dried, concentration was made, and then brown residue was obtained. The residue was recrystallized from methanol and then 3.9 g (58%) of white powders was obtained. The constituent of the compound was proved by menus of NMR.

(e) Synthesis of the sample coupler No. 1

After the intermediate D of 2.0 g, was dissolved in ethylacetate, the solution was ice cooled and stirred, and then ethylacetate solution of 0.43 g of sulfurylchloride was dropped therein. After dropped in, the temperature was restored to the room temperature and the reaction was made for four hours. After the mixture reacted was washed and dried up, concentration was made, and the residue was recrystallized from acetonitrile. The white powders of 1.0 g (47%) was obtained.

The couplers of the invention include the oil-soluble and alkali-soluble of which the oil-soluble couplers are so-called as oil-protect type couplers and may be dissolved in organic solvent having high boiling point and then may be dispersedly contained in the color emulsions. And the alkali-soluble couplers may be dispersedly contained in the color emulsions by applying Fischer's dispersing method, of which examples may be given as the afore described sample coupler [7], etc. The resulted color emulsion is coated on an adequate photographic support.

Among couplers of the present invention, oil protect type coupler, for example, may be contained in color emulsion by the conventional method known. For example, after dissolving the coupler of the present invention idependently or in combination in individual or in mixed liquid at need of organic solvent with high boiling point of more than 175° C. such as tricresylphosphate and dibutylphthalate etc. and solvent with low boiling point such as butylacetate and butyl propionate etc., it is possible to mix it with aqueous gelatin solution containing surface active agent and to prepare silver halide emulsion to be used for the present invention by adding to silver halide after emulsifying with a high speed rotation mixer or a colloid mill.

Regarding such coupler as a coupler in developer type of the present invention, the coupler having the body structure and split-off group has various application due to the combination thereof. Namely, in case the coupler residual group is the one having the diffusibility in which the water-soluble group such as sulfonic acid group and carbocyclic acid group etc. is substituted, or in case the split-off group itself of the present invention is the one that is diffusble the coupler of the present invention is used as the diffusible coupler, for example, it is used for the photographic technology of so-called coupler in developer type and in that case, the coupler can be used by containing it in the color developer. For example, illustrated coupler 9 may be given.

Further, when the coupler of the present invention is the one with the type of non-diffusion with cyan coupler residual group that is nondiffusible and with split-off group that is diffusible, it is suitable to be used for the diffusion transfer process. In order to give diffusibility to each group, the means to select the group with low molecular weight for example and/or to induce the water-soluble group such as aforesaid sulfonic acid group for example, may be used and in order to give nondiffusing property to cacy group, the means to induce long chain aliphatic hydrocarbon residual group and/or to select the relatively high molecular group, my be used.

This diffusion transfer process has an image forming method to utilize cyan dye obtained by the reaction of cyan coupler residual group and color developing agent and an image forming method to utilize the split-off group part that split off when color developing, and an image forming method related to the present invention can be applied to the latter case and the compound obtained with splitting off of the split-off group from the active point of the coupler needs to be diffusive. And in case this split off compound is used, said compound needs to be colored and it is required, for example, that dye portion of azo dye etc. is contained in the compound. This dye portion preferably is the one having water-soluble group and azo dye, azomethine dye, indoaniline dye, indophenol dye and anthraquinon dye etc. are given as the typical one. As the coupler of the present invention that is most suitable to be used for the diffusion transfer process, illustrated coupler [7] is given for example.

As silver halide used for silver halide emulsion that is useable in the present invention, any silver halide to be used for ordinary silver halide emulsion such as silver bromide, silver chloride, silver iodobromide, silver chlorobromide and silver chloroiodobromide etc. are given.

Further, it is possible to make silver halide emulsion of the present invention contain various kinds of known photographic additives.

As a spectral sensitizing dye to be used advantageously in the present invention, cyanine dye, merocyanine dye or compound cyanine dye as described in U.S. Pat. Nos. 2,269,234; 2,270,378; 2,442,710; 2,454,629; 2,776,280 for example, are given.

Color developer that can be used for the present invention is preferably the one containing aromatic primary amine group color developing agent as the principal ingredient. As a concrete example of this color developing agent, the one in p-phenylenediamine group is typical and as an example, diethyl-p-phenylenedianine hydrochloric acid salt and mono-methyl-p-phenylenediamine hydrochloric acid salt, dimethyl-p-phenylenediamine hydrochloric acid salt, 2-amino-5-diethyl-aminotoluene hydrochloric acid salt, 2-amino-5-(N-ethyl-N-dodecylamino)toluene, 2-amino-5-(N-ethyl-N-β-methanesulfone-amidoethyl)aminotoluene sulfuric acid salt, 4-(N-ethyl-N-β-methane sulfoneamidoethylamino)aniline, 4-(N-ethyl-N-β-hydroxy ethylamino)aniline and 2-amino-5-(N-ethyl-N-methoxyethyl)aminotoluene etc. are given.

And such color developing agent is used independently or in the mode of combination of more than two kinds thereof or together with black-and-white developing agent such as hydroquinone for example, if necessary. Further, color developer generally contains alkaline agent such as sodium hydroxide, ammonium hydroxide, sodium carbonate, sodium sulfate and sodium sulfite etc. for example and further may contain various kinds of additives such as alkaline metal halide and potassium bromide for example.

In the color developing method to be used for the present invention, color development is made by the ordinary coupler in emulsion type color developing process after the photosensitive material is exposed and this color developer is exceptionally contained in the image receiving material in the diffusion transfer process of certain kind for example and in such technology, it is possible to separate color developing agent from alkaline agent and to process with other liquid containing alkaline agent or color developing agent when developing by using the method wherein alkaline agent alone or color developing agent alone is contained in the image receiving material.

As color developing liquid for the aforesaid coupler in emulsion type, the one with the following composition can be given as a typical example.

| [Composition of color developer] | |
|---|---|
| 4-amino-3-methyl-N—ethyl-N—(-methane sulfoneamidoethyl)-aniline sulfuric acid salt | 5.0 g |
| Sodium sulfite (anhydr) | 2.0 g |

-continued

| [Composition of color developer] | |
|---|---|
| Sodium carbonate (1 hydrate) | 50 g |
| Potassium bromide | 1.0 g |
| Potassium hydroxide | 0.55 g |
| Add water to make | 1 l |

The coupler of the present invention contained in the color emulsion to be used for the present invention reacts with product oxide of color developing agent that is produced when silver halide is developed by such color developer and forms cyan dye.

After the processing of such color development, an ordinary photographic processing such as a pertinent combination of processis selected from the process by the processing liquid such as stop solution containing organic acid, stop/fix solution containing fixing ingredient of organic acid and hypo or ammonium thiosulfate, fixing solution containing fixing ingredient of hypo or ammonium thiosulfate, bleaching liquid containing ferric salt of aminopolycarboxylic acid and alkali halide as a principal ingredient, bleaching and fixing solution containing fixing ingredient of ferric salt of aminopolycarboxylic acid and sodium thiosulfate or ammonium thiosulfate etc. and other stabilizing liquid, and from the process of washing and drying etc., may be done.

Next, a typical concrete example of color developing process wherein the present invention can be used for the process of coupler in emulsion type color negative photosensitive material, will be shown.

| [Process] | |
|---|---|
| Processing step (33° C.) | Processing time |
| Color development | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

Composition of each processing liquid that can be used in the aforesaid process is as follows, for example.

| [Composition of color developer] | |
|---|---|
| 4-amino-3-methyl-N—ehtyl-N—(β-hydroxyethyl)-aniline sulfuric acid salt | 4.8 g |
| Sodium sulfite anhydride | 0.14 g |
| Hydroxylamine, ½ sulfuric acid salt | 1.98 g |
| Sulfuric acid | 0.74 mg |
| Potassium carbonate anhydride | 28.85 g |
| Potassium hydrogen carbonate anhydride | 3.46 g |
| Potassium sulfite anhydride | 5.10 g |
| Potassium bromide | 1.16 g |
| Sodium chloride | 0.14 g |
| Nitrilo acetic acid, 3 sodium salt (1 hydrate) | 1.20 g |
| Potassium hydroxide | 1.48 g |
| Add water to make | 1 l |

| [Composition of bleaching liquid] | |
|---|---|
| Ammonium ferric ethylenediaminetetra acetate | 100 g |
| Ethylenediaminetetra acetic | |

-continued

| [Composition of bleaching liquid] | |
|---|---|
| acid 2 ammonium salt | 10 g |
| Ammonium bromide | 150 g |
| Glacial acetic acid | 10 mg |
| Add water to make | 1 l |
| and adjust to pH 6.0 using aqueous ammonia | |

| [Composition of fixing liquid] | |
|---|---|
| Ammonia thiosulfate | 175.0 g |
| Sodium sulfite anhydride | 8.6 g |
| Sodium metasulfite | 2.3 g |
| Add water to make | 1 l |
| and adjust to pH 6.0 using acetic acid | |

| [Composition of stabilizer] | |
|---|---|
| Formalin (37% water solution) | 1.5 mg |
| Konidacks (made by Konishiroku Photo Ind. Co., Ltd.) | 7.5 mg |
| Add water to make | 1 l |

A typical concrete example of color developing process wherein the present invention can be used for the process of coupler in emulsion type color photographic material, will be shown next.

| [Process] | |
|---|---|
| Processing step (30° C.) | Processing time |
| Color development | 3 min. 30 sec. |
| Bleaching and fixing | 1 min. 30 sec. |
| Washing | 2 min. |
| Stabilizing | 1 min. |

Composition of each processing liquid that can be used in the aforesaid process is as follows for example.

| [Composition of color developer (1)] | |
|---|---|
| 4-amino-3-methyl-N—ethyl-N—(β-methane sulfoneamidoethyl)-aniline sulfuric acid salt | 5.0 g |
| Sodium hexametaphosphate | 2.5 g |
| Sodium sulfite anhydride | 1.85 g |
| Sodium bromide | 1.4 g |
| Potassium bromide | 0.5 g |
| Borax | 39.1 g |
| Add water to make | 1 l |
| and adjust to pH 10.30 using sodium hydroxide | |

| [Composition of color developer (2)] | |
|---|---|
| 4-amino-3-methyl-N—ethyl-N—(β-methane sulfoneamidoethyl)-aniline sulfuric acid salt | 5.0 g |
| Benzyl alcohol | 15.0 ml |
| Sodium hexametaphosphate | 2.5 g |
| Sodium sulfite anhydride | 1.85 g |
| Sodium bromide | 1.4 g |
| Potassium bromide | 0.5 g |
| Borax | 39.1 g |
| Add water to make | 1 l |
| and adjust to pH 10.30 using sodium hydroxide | |

Aforesaid color developer (1) is a composition of color developer from which benzyl alcohol is not added and color developer (2) is a composition of ordinary color developing liquid to which conventional benzyl alcohol is added. In case the present invention is used for the process of coupler in emulsion type color photographic material, aforesaid color developer (1) and (2) can be used and from the view point of anti-pollution measure, the use of aforesaid color developer (1) is desired and in the present invention, good photographic characteristics are obtained in the use of this desirable color developer (1).

| [Composition of bleaching and fixing liquid] | |
|---|---|
| Ammonium ferric ethylenediaminetetra acetate | 61.0 g |
| Ethylenediaminetetra acetic acid 2 ammonium salt | 5.0 g |
| Ammonium thiosulfate | 124.5 g |
| Sodium metabisulfite | 13.3 g |
| Sodium sulfite anhydride | 2.7 g |
| Add water to make | 1 l |

| [Composition of stabilizer] | |
|---|---|
| Glacial acotic acid | 20 ml |
| Add water to make | 1 l |
| and adjust to pH 3.5–4.0 using sodium acetate | |

The present invention will be explained concretely with an example as follows.

EXAMPLE (1)

Couplers of the present invention (shown with the numbers of aforesaid concrete example) as shown in Table 1 described later and the following comparison couplers [A], [B] and [C] were used and 10 g of each coupler was added to the mixed solution of 2.5 ml of dibutyl phthalate and 20 ml of ethyl acetate and then heated to 60° C. and dissolved completely. The solution thus obtained was mixed with 5 ml of 10% water solution of alkanol B (alkyl naphthalene sulfonate, made by E. I. DuPont de Nemours & Co.) and 200 ml of 5% water solution of gelatin and then was emulsified by the colloid mill and dispersed liquid of each coupler was prepared. Then, this coupler dispersed liquid was added to 500 g of gelatin-silver chlorobromide (containing silver bromide of 20 mol%) emulsion and was coated and dried on polyethylene covered paper and 6 kinds of silver halide photosensitive material for color photography having stable coated film (sample Nos. [1]–[6]) were obtained. Samples of 6 kinds of silver halide photosensitive material for color photography obtained were given a wedge exposure according to the ordinary method and then, as a concrete example, was given a color development according to aforesaid coupler in emulsion type color developing process and cyan color image was obtained. Incidentally, 2 kinds of composition of one with benzyl alcohol added [aforesaid color developer (2)] and the other without benzyl alcohol added [aforesaid color developer (1)] were used as color developing liquid. Photographic characteristics were measured for each of the samples obtained. The results thereof are shown in Table 1.

TABLE 1

| Sample No. | Coupler used | | With benzyl alcohol added: Sensitivity | With benzyl alcohol added: Maximum density (Dmax) | Without benzyl alcohol added: Sensitivity | Without benzyl alcohol added: Maximum density (Dmax) | Maximum absorption Wave-length (m,u) |
|---|---|---|---|---|---|---|---|
| 1 | Illustrated coupler | (1) | 100 | 2.20 | 85 | | |
| 2 | Illustrated coupler | (12) | 100 | 2.20 | 80 | 2.02 | 650 |
| 3 | Illustrated coupler | (28) | 100 | 2.20 | 75 | 1.86 | 652 |
| 4 | Comparison coupler | A | 100 | 2.20 | 55 | 1.52 | 655 |
| 5 | | B | 95 | 1.91 | 60 | 1.55 | 645 |
| 6 | | C | 100 | 1.81 | 50 | 1.53 | 655 |

Incidentally, the values of sensitiveity in the table are shown as a relative value against the value of 100 that is the sensitivity of sample (4) with benxyl alcohol added wherein comparison coupler [A] is used. The structures of comparison coupler [A], [B] and [C] are as follows.

Comparison coupler [A]

6-[α-(2,4-di-tert-amylphenoxy)butane amide]-2,4-dichloro-3-methylphenol (the one described in aforesaid U.S. Pat. No. 2,801,171)

Comparison coupler [B]

2-benzamide-5-[α-(4-butylsulfonyl-aminophenoxy)tetradecanamide]phenol (the one in U.S. Pat. No. 4,124,396)

Comparison coupler [C]

6-[α-(2,4-di-n-amylphenoxy)butaneamide]-2-chloro-3-methyl-4-(1-phenyl-5-tetrazolyloxy)phenol (the one described in aforesaid U.S. Pat. No. 3,839,044)

As is clear from aforesaid table 1, samples processed with an image forming method of the present invention have a desirable spectral absorption characteristics and further it is noticed that the sensitivity and the maximum dersity of the color image obtained with color developer having no benzyl alcohol added are greater than any of the comparison couplers [A], [B] and [C].

EXAMPLE (2)

In the same manner as foregoing example (1), 6 kinds of samples 7-12 of photosensitive material for cyan color image forming were obtained and light-resisting property, heat-resisting property and humidity-resisting property thereof were checked. Results obtained are shown on table 2.

In the table, values of light-resisting property represent the residual density of each image after the exposure by a xenon fade meter for 200 hours with the density before the exposure the value of which is 100. Values of humidity-resisting property represent the residual density after the preservation for two weeks under the condition of 60° C. and 80% of relative humidity with the density before the test the value of which is 100. Further, values of heat-resisting property represent the residual density after the preservation for two weeks under the condition of 77° C. with the density before the test the value of which is 100.

As is evident from Table 2, comparison couplers [A] and [C] have an excellent capacity in the light-resisting property but they are problematic on the heat-resisting property. The heat-resisting property of the comparison coupler [B] is improved compared with the one for comparison couplers [A] and [C] but the comparison coupler [B] is problematic on the light-resisting property.

On the other hand, illustrated couplers (1), (14) and (31) concerning the present invention have the heat-resisting property that is the same as that of the coupler [B] and the effect of the improvement in their light-resisting property is noticed.

EXAMPLE (3)

Aforesaid illustrated coupler (10) or aforesaid comparison coupler A, 10 g thereof was added to the mixed solution of 25 ml of dibutylphthalate and 20 ml of ethyl acetate and was heated up to 60 C. and was completely dissolved. The solution thus obtained was mixed with 5 ml of 10% water solution of alkanol B and 200 ml of 5% water solution of gelatin and was emulsified by the colloid mill and dispersion liquid of coupler was pre-

TABLE 2

| Sample No. | Coupler used | With benzyl alcohol added: Light-resisting property | With benzyl alcohol added: Heat-resisting property | With benzyl alcohol added: Humidity-resisting property | Without benzyl alcohol added: Light-resisting property | Without benzyl alcohol added: Heat-resisting property | Without benzyl alcohol added: Humidity-resisting property |
|---|---|---|---|---|---|---|---|
| 7 | Illustrated coupler (1) | 95 | 100 | 100 | 95 | 100 | 100 |
| 8 | Illustrated coupler (14) | 93 | 100 | 98 | 93 | 100 | 98 |
| 9 | Illustrated coupler (31) | 91 | 100 | 98 | 92 | 100 | 97 |
| 10 | Comparison coupler A | 91 | 65 | 73 | 90 | 64 | 72 |
| 11 | Comparison coupler B | 72 | 100 | 98 | 71 | 100 | 97 |
| 12 | Comparison coupler C | 90 | 65 | 72 | 90 | 65 | 71 |

pared. Next, this dispersion liquid was added to 500 g of emulsion of high sensitive gelatin silver iodobromide (containing 6.0 mol% of silver iodide) for the negative and then was coated and dried on the cellulose aceta e film base, thus samples 13 and 14 of silver halide photographic photosensitive material having the stable coated film were obtained. This silver halide photographic photosensitive material was exposed in the same manner as example (1) and color developing was conducted according to aforesaid coupler in emulsion type color developing process for color negative and cyan color images were obtained.

Photographic characteristics of cyan color images thus obtained were measured. The results thereof are shown in Table 3.

TABLE 3

| Sample No. | Coupler used | Relative sensitivity | Maximum density (Dmax) | Maximum absorption wavelength (λmax) |
|---|---|---|---|---|
| 13 | Illustrated coupler (10) | 100 | 2.60 | 650 |
| 14 | Comparison coupler A | 57 | 1.51 | 660 |

As is evident from Table 3, it is noticed that the sample with the coupler of the present invention used therein has the high maximum density. And the sample of the present invention has cyan negative color images with an excellent transparency.

EXAMPLE (4)

Aforesaid illustrated coupler [7] that is a coupler of the present invention was contained in the ordinary high sensitive silver iodobromide emulsion for the negative by the Fischer dispersion method (0.2 mol amount was used for 1 mol of silver halide), and this emulsion was coated on the triacetate film base by the ordinary method and then dried.

Samples thus obtained were exposed in the same manner as example (1) and then they were processed for 3 minutes at 24° C. with the use of alkaline developer with following composition.

| Composition of developing liquid | |
|---|---|
| Sodium sulfite | 20 g |
| 4-N—ethyl-N—β-hydroxyethyl-aminoaniline | 11.0 g |
| Add water to make | 1 l |

At the time of this development, the image receiving layer of the image receiving material wherein the image receiving layer containing dimethyl-β-hydroxyethyl-γ-stearoamidepropylammonium-hydrogenphosphate is provided on the polyethylene-covered paper was contacted with the photosensitive layer of the aforesaid sample and after the development, the image receiving material was peeled off. Thereupon, in the same manner as aforesaid examples (1), (2) and (3), clear cyan positive image with high maximum density and excellent photographic characteristics was obtained on the image receiving material, and it was confirmed that the coupler of the present invention has an excellent property even as a coupler for diffusion transfer process.

EXAMPLE (5)

An illustrated coupler (9) was dissolved in methanol and by adding this, coupler in developer type color developing liquid with following composition was prepared.

| Coupler in developer type color developing liquid | |
|---|---|
| N,N—diethyl-2-methyl-p-phenylenediamine | 2.0 g |
| Sodium sulfite anhydride | 2.0 g |
| Sodium carbonate (1 hydrate) | 20.0 g |
| Potassium bromide | 1.0 g |
| Illustrated coupler (9) | 2.0 g |
| Add water to make | 1 |

A sample obtained by coating the high sensitive silver iodobromide emulsion onto the subcoated polyethyleneterephthalate film was given an exposure in the ordinary method and then was developed for 30 minutes at 24° C. with aforesaid coupler in developer type color developing liquid.

After the development, washing for 4 minutes, bleaching for 5 minutes, washing for 5 minutes, fixing for 5 minutes, washing for 30 minutes and drying were given successively in the ordinary method, upon which, cyan image with absorption maximum of 670 nm and excellent spectral absorption characteristics and also with excellent other photographic characteristics was obtained.

What is claimed is:

1. A method for forming a cyan dye image which method consists developing an imagewisely exposed silver halide emulsion layer with an aromatic primary amine color developing agent in the presence of a 2,5-diacylaminophenol cyan coupler containing a substituted alkylsulfonylamino terminal moiety or a substituted alkylaminosulfonyl terminal moiety in the 2- or 5-position of the molecule.

2. A method according to claim 1 wherein the 2,5-diacylaminophenol cyan coupler is represented by the formula [I] or [II]:

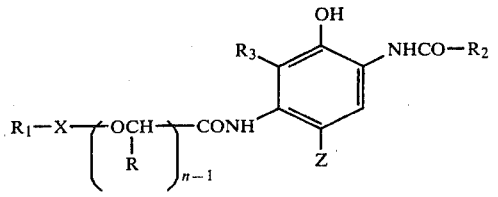

[I]

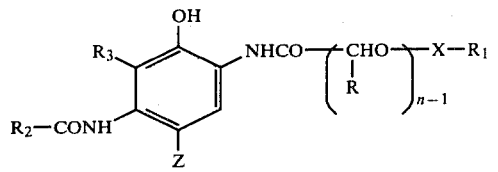

[II]

wherein, R represents hydrogen atom, or alkyl group haveing 1 to 20 numbers of carbon; $R_1$ represents substituted alkylsulfonylamino group or substituted alkylaminosulfonyl group; $R_2$ represents alkyl group, aryl group, or heterocyclic group; $R_3$ represents hydrogen atom or halogen atom; X represent phenylene group, naphthylene group or alkylene group; Z represents a coupling-off group; and n has an integral value of 1 or 2.

3. A method according to claim 2, wherein $R_1$ is $Y—R_4—SO_2NH—$ or $Y—R_4—NHSO_2—$ wherein $R_4$ is alkylene, Y is selected from a group consisting of R'O—, R'COO—, R'OCO—, R'S—, $R'SO_2$—, R'CO—,

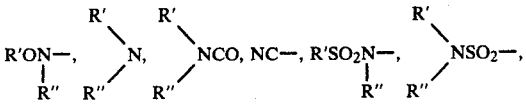

$R'OSO_2$—, $R'SO_2O$—, $O_2N$—, and halogen, wherein each of R' and R'' is hydrogen, alkyl, phenyl or 4 to 6 membered heterocycle containing oxygen, nitrogen or sulfur or R' and R'' together form a 4 to 6 membered heterocycle containing oxygen, nitrogen or sulfur.

4. A method according to claim 2 wherein X is a phenylene group.

5. A method according to claim 3 wherein $R_1$ is $Y—R_4—SO_2NH—$ wherein Y and $R_4$ have the same meanings as defined in claim 3.

6. A method according to claim 2 wherein the 2,5-diacylaminophenol cyan conpler is represented by the formula [I] as defined in claim 2.

* * * * *